US009105392B2

(12) United States Patent
Yang

(10) Patent No.: US 9,105,392 B2
(45) Date of Patent: Aug. 11, 2015

(54) STRUCTURE OF TRANSFORMER'S LEAD FRAME

(71) Applicant: Sen-Tai Yang, New Taipei (TW)

(72) Inventor: Sen-Tai Yang, New Taipei (TW)

(73) Assignee: Yujing Technology Co., Ltd., New Taipei (TW)

( * ) Notice: Subject to any disclaimer, the term of this patent is extended or adjusted under 35 U.S.C. 154(b) by 0 days.

(21) Appl. No.: 14/206,267

(22) Filed: Mar. 12, 2014

(65) Prior Publication Data

US 2014/0266540 A1 Sep. 18, 2014

(30) Foreign Application Priority Data

Mar. 13, 2013 (TW) ..... 102108770 A

(51) Int. Cl.

| | |
|---|---|
| ***H01F 27/30*** | (2006.01) |
| ***H01F 27/28*** | (2006.01) |
| ***H01F 27/29*** | (2006.01) |
| ***H01F 27/26*** | (2006.01) |
| *H01F 27/06* | (2006.01) |

(52) U.S. Cl.

CPC ..... *H01F 27/29* (2013.01); *H01F 27/2866* (2013.01); *H01F 27/306* (2013.01); *H01F 2027/065* (2013.01)

(58) Field of Classification Search

CPC ..... H01F 27/28; H01F 27/29; H01F 27/30; H01F 27/26

USPC ..... 336/180, 193, 198, 210, 223, 225, 19

See application file for complete search history.

(56) References Cited

U.S. PATENT DOCUMENTS

| | | | | |
|---|---|---|---|---|
| 4,176,335 | A * | 11/1979 | Charpentier | 336/180 |
| 6,559,749 | B1 * | 5/2003 | Weiner | 336/192 |
| 7,180,398 | B2 * | 2/2007 | Hoffmann et al. | 336/208 |
| 2007/0057757 | A1 * | 3/2007 | Chen et al. | 336/212 |
| 2009/0309686 | A1 * | 12/2009 | Espino | 336/182 |
| 2011/0193673 | A1 * | 8/2011 | Tsai et al. | 336/84 M |

FOREIGN PATENT DOCUMENTS

GB 864046 A * 3/1961

* cited by examiner

*Primary Examiner* — Tsz Chan

(74) *Attorney, Agent, or Firm* — Pro-Techtor Int'l Services

(57) ABSTRACT

An improved structure of transformer's lead frame includes at least a lead frame module consisting of a lead frame main body and a lead frame cover, the lead frame main body has a through hole furnished at the center thereof; a bobbin formed at the side of the circumference of the through hole, and a pair of oppositely configured and reversely salient extension parts furnished at sides of the circumference of the through hole, each of the extension parts is combined to the mid-section of the wire connecting seats that have a plurality of wire connecting posts, a plurality of clip indentations are furnished at intervals and at the mid-section of the edge of the two sides of the corresponding extension parts and at the positions covered by the width of the corresponding extension parts.

1 Claim, 7 Drawing Sheets

STRUCTURE OF TRANSFORMER'S LEAD FRAME

BACKGROUND OF THE INVENTION

1. Field of the Invention

The invention relates to an improved structure of transformer's lead frame, and more particularly, to an improved structure of transformer's lead frame capable of providing temporary positioning of the coil's drawing heads to prevent the iron core' assembling work from being interfered by the occupied position of the coil's drawing heads.

2. Description of the Prior Art

FIG. 1 is an isometric exploded view of the structure of the transformer or inductance of the prior art while FIG. 2 is an isometric view of the assembled outward appearance of the structure of the transformer or inductance of the prior art. As shown in FIG. 1 and FIG. 2, the transformer or conductor structure of the prior art mainly includes a lead frame (8), iron core (9, and coil (821) where the lead frame (8) has a central hole (81) furnished at the center thereof. A bobbin (82) furnished around the outer circumference of the central hole (81) for the coil (821) (the coil 821 includes a primary winding, a secondary winding, and, according to the requirement, a control winding) to be wound. A pair of extension parts (83), (831) are furnished near the central hole and extended toward both side therefrom. These extension parts (83), (831) are connected to the mid-section of two wire connecting seats (84), (841). Two wire connecting posts (85), (851) that pull out drawing heads from the coil (821) are furnished at the extension parts (83), (831). The iron core (9) has a main core part (91) furnished at the center of the inner side surface thereof. The main core part (91) has a containing circumferential trench (93) furnished at the periphery thereof, and at the periphery of the containing circumferential trench (93) has two oppositely configured side openings (94), (941) that are outwardly communicative. Two oppositely configured side parts (92) are naturally formed for the rest of the part of the outer circumference of the containing circumferential trench (93). When it comes to assembling, the two main core parts (91) will contact each other after the main core parts (91) of the two iron cores (9) are stretched through the central hole (81) of the lead frame (8). In the mean time, the containing circumferential trench (93) will contain the lead frame (8) and the two extension parts (83), (831) will stretch outward through the side openings (94), (941) making the wire connecting seats (84), (841) and the wire connecting posts (85), (851) keep at the position outside the iron core (9). In this way, the circumference of the coil (821) in the bobbin (82) is capable of forming a magnetic loop.

In accordance with the machining process in production, conductive wire or enamel covered wire is wound around the bobbin (82) of the lead frame (8) (to form coil 821), then the lead frame (8) is combined between the two iron cores (3). However, since there is no furnished mechanism of temporary fixing for the drawing heads of the coil (821), the current method is to have the drawing heads directly braze and connect to the wire connecting posts (85), (851) after the winding work of the coil is completed, i.e. the drawing heads are directly braze to the wire connecting posts (85), (851), then the lead frame (8) is combined to the two iron core (9) or the drawing heads are temporary fixed by other methods, afterward, the drawing heads are brazed to the wire connecting posts (85), (851).

Nevertheless, in actual operation, in order to diminish magnetic leakage, generally, the width of the side openings (94), (941) of the iron core (9) is only allowed to be passed through the extension parts (83), (831), and the width of the wire connecting seats (84), (841) of the lead frame is much larger than the width of the extension parts (83), (831). As a result, after the winding work of the coil (821) is completed, the extension direction and position are different following the different positions of the wire connecting posts (85), (851) of the corresponding connection; as the drawing heads A and B shown in FIG. 1, the drawing head B is connected to the wire connecting posts (85) that is relatively closer to the center part, its extended position will keep within the extension part (83), thereby it will not interfere the assembling work of the following iron core (9). However, the drawing head A is connected to the wire connecting post (85) that is relatively closed to the outer part, thereby, if in negligence, the extension position is quite possible to be directly moved to the outside of the extension part (83). At this moment, it is necessary to remove that will directly affect the overall assembling efficiency, otherwise, if in negligence, it will result in defective product.

Therefore, the structure of the transformer's lead frame is still needed to be improved in practical application.

SUMMARY OF THE INVENTION

In light of the above-mentioned disadvantages of the prior art, the invention provides an improved structure of transformer's lead frame that is capable of overcoming the shortcomings of the prior art, satisfying the requirements of the industry, as well as improving the competitiveness in the market. It aims to ameliorate at least some of the disadvantages of the prior art or to provide a useful alternative.

The primary objective of the invention is to provide an improved structure of transformer's lead frame that is capable of providing the mechanism of various temporary positioning of the drawing heads after the assembling work of the coil is completed to prevent the following assembling work of the iron core from being interfered by the of the position of the coil's drawing heads.

The secondary objective of the invention is to provide an improved structure of transformer's lead frame that employs a removable design of lead frame cover to provide a conveniency of having the assembly of the secondary winding of metal sheet forming to form a metal sheet to fit the direction furnishing of the main core part of the iron core, and the main core part of the iron core is an upright extended transformer structure to further elevate the product's versatility and competitiveness in the market.

To achieve the above-mentioned objectives and efficacies, the employed technical means includes an improved structure of transformer's lead frame includes at least a lead frame module consisting of a lead frame main body and a lead frame cover, the lead frame main body has a through hole furnished at the center thereof; a bobbin formed at the side of the circumference of the through hole, and a pair of oppositely configured and reversely salient extension parts furnished at sides of the circumference of the through hole, each of the extension parts is combined to the mid-section of the wire connecting seats that have a plurality of wire connecting posts, a plurality of clip indentations are furnished at intervals and at the mid-section of the edge of the two sides of the corresponding extension parts and at the positions covered by the width of the corresponding extension parts.

In accordance with the above-mentioned structure, the lead frame module is consisted of a lead frame main body and a lead frame cover, the lead frame main body having a bobbin and a through hole furnished at the center thereof has a pair of oppositely configured and reversely salient extension parts that are connected to the mid-section of a wire connecting seats respectively; the lead frame main body also has at least a pair of oppositely configured combining parts furnished at the edge of the other end of the through hole; the lead frame cover being a sheet body and having a through hole furnished at the center thereof and corresponded to the through hole of the through hole has at least two to-be-combined parts furnished at the inner edge of the circumference of the through hole and corresponded to each of the combining parts, the lead frame cover also has a plurality of clip indentations furnished at intervals and at the mid-section of the edge of the two sides of the corresponding extension parts In accordance with the above-mentioned structure, the combining parts is a hook part and the to-be-combined parts is a reverse hook part In accordance with the above-mentioned structure, the bobbin of the lead frame main body provides the trouser-like flap that has its hollow part capable of slipping on the bobbin, and a pair of wire connecting legs are provided at an end of the trouser-like flap, and one of the wire connecting seats of the lead frame main body has a plurality of indented openings furnished at one of the wire connecting seats of the lead frame main body for containing the wire connecting legs.

In accordance with the above-mentioned structure, two parallel stretching thigh parts of the trouser-like flap are provided between the hollow part and the wire connecting legs and the two parallel wire connecting legs.

In accordance with the above-mentioned structure, a conducting wire is employed to wind in the bobbin to obtain the required winding that includes at least a primary winding.

In accordance with the above-mentioned structure, the lead frame main body has a plurality of spare conducting posts furnished at the wire connecting seats having indented openings.

In accordance with the above-mentioned structure, the bobbin is provided to be wound a winding that further comprises a primary winding and at least a secondary winding In accordance with the above-mentioned structure, the through hole is provided for the predetermined main core parts of the two same iron cores to be stretched through, making the two same iron cores contact each other, each of the iron cores has two oppositely configured side wing parts furnished at the outer side of the main core part, and a containing circumferential trench formed between the main core part and the side wing part has two oppositely configured side openings.

In accordance with the above-mentioned structure, the two extension parts are outwardly stretched through the side openings.

The accomplishment of this and other objectives of the invention will become apparent from the following description and its accompanying drawings of which:

DETAILED DESCRIPTION OF THE PREFERRED EMBODIMENT

Figure 1:
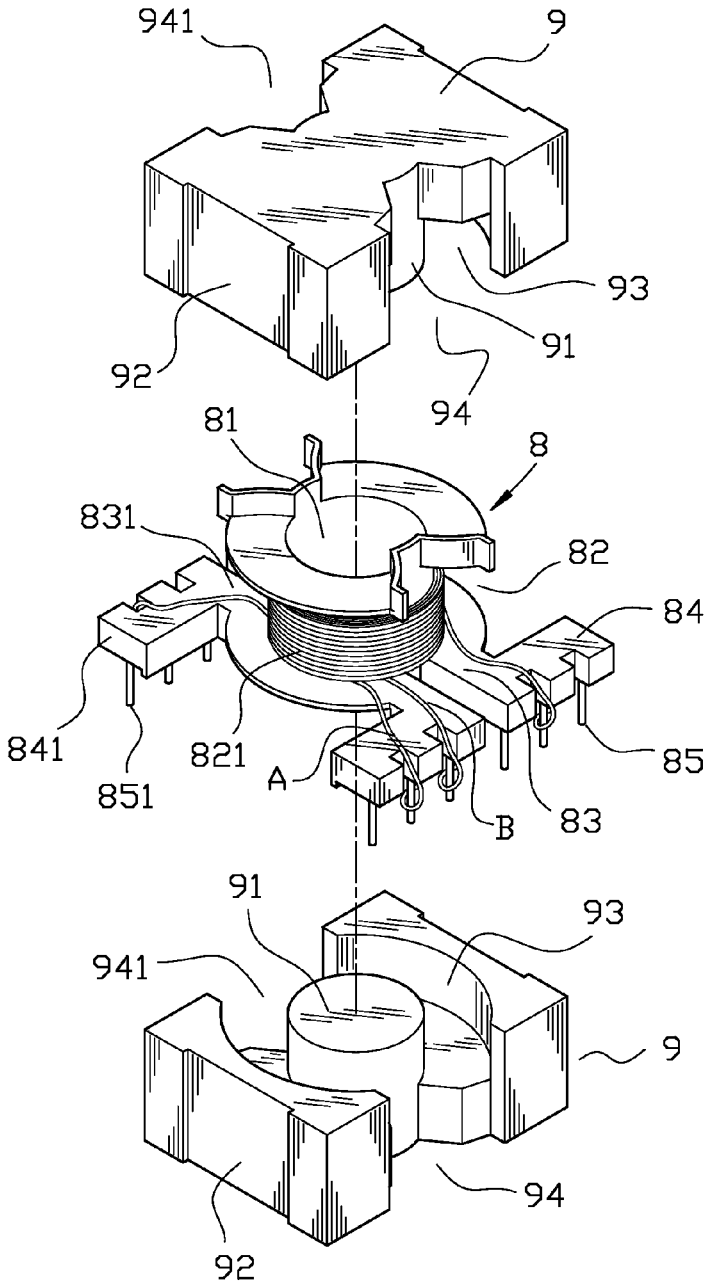
Fig.1 (Prior Art)
FIG. 1 is an isometric exploded view of the structure of the transformer or inductance of the prior art.
Figure 2:
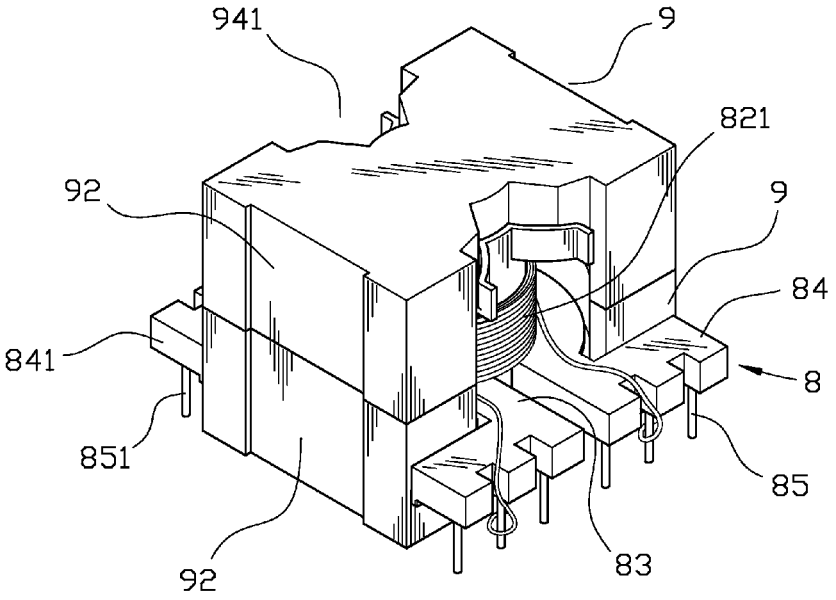
Fig.2 (Prior Art)
FIG. 2 is an isometric view of the assembled outward appearance of the structure of the transformer or inductance of the prior art.
Figure 3:
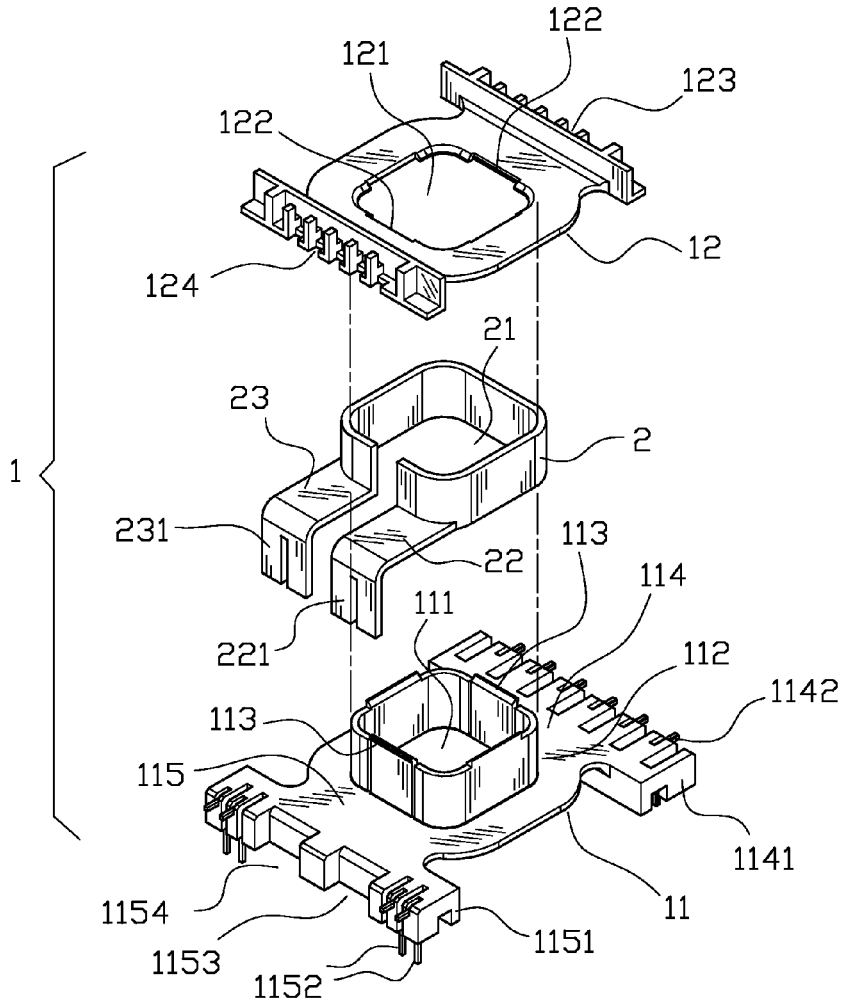
FIG. 3 is an isometric exploded view of the improved structure of transformer's lead frame of the first embodiment of the invention.

FIG. 3 is an isometric exploded view of the improved structure of transformer's lead frame of the first embodiment of the invention. As shown in FIG. 3, the improved structure of transformer's lead frame of the invention is the one applicable to employing the trouser-like flap (2) as a secondary winding. The invention mainly includes a lead frame module (1). The lead frame module (1) is consisted of a lead frame main body (11) and a lead frame cover (12). The lead frame main body (1) having a pipe-shaped bobbin (112) and a through hole (111) furnished at the center thereof has a pair of oppositely configured and reversely salient extension parts (114), (115) that are connected to the mid-section of a wire connecting seats (1141), (1151) respectively. The wire connecting seat (1141) has a plurality of primary-winding conducting posts (1142) furnished thereof while the wire connecting seat (1151) has a plurality of spare conducting posts (1152) and two indented opening (1153), (1154) furnished thereof. Moreover, the lead frame main body (11) also has a pair of oppositely configured combining parts (113) (can be a hook part) furnished at the edge of the other end of the through hole (111).

The lead frame cover (12) being a sheet body and having a through hole (121) furnished at the center thereof and corresponded to the through hole (121) of the through hole (111) has at least two to-be-combined parts (122) (can be a reverse hook part) furnished at the inner edge of the circumference of the through hole (121) and corresponded to each of the combining parts (113) (the hook part). Moreover, the lead frame cover (12) also has a plurality of clip indentations (123), (124) furnished at intervals and at the mid-section of the edge of the two sides of the corresponding extension parts (114), (115) and at the positions covered by the width of the corresponding extension parts (114), (115).

There is also a trouser-like flap (2) that has a hollow part (21) capable of slipping on the bobbin (112), two parallel stretching thigh parts (22), (23), and two parallel wire connecting legs (221), (231).

Figure 4:
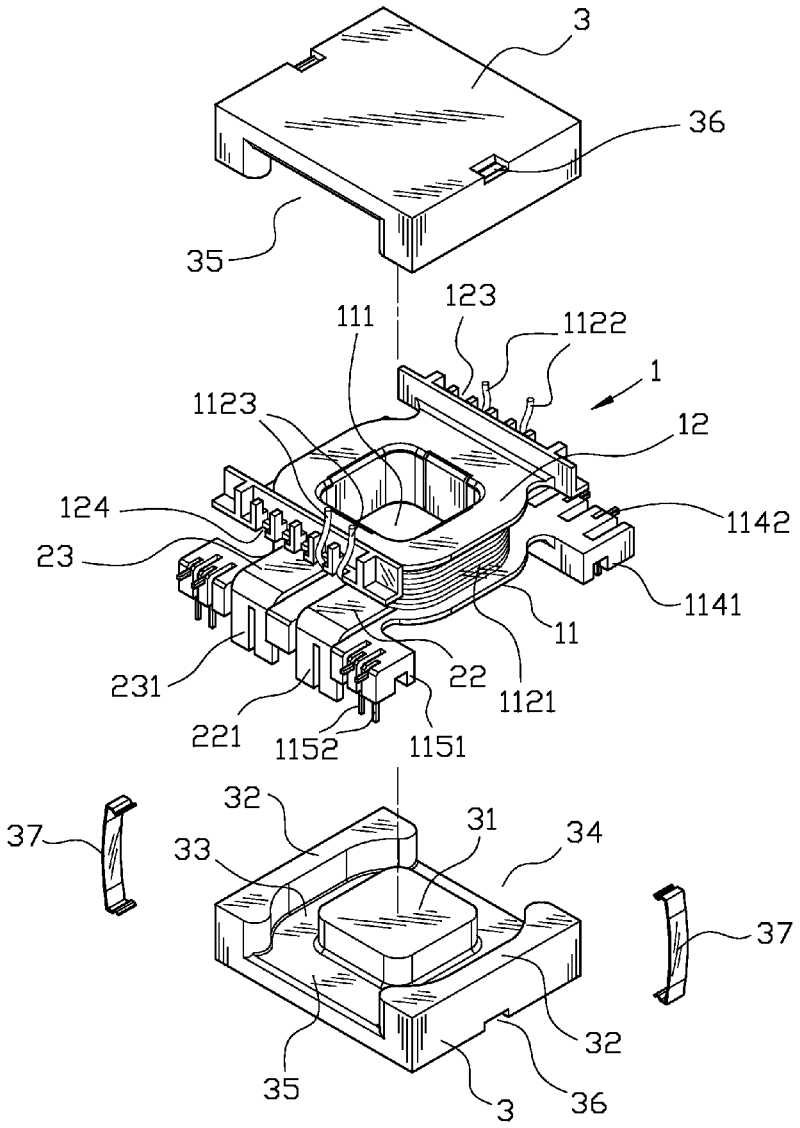
FIG. 4 is an isometric exploded view and schematic diagram of the partially assembled improved structure of the transformer's lead frame of the first embodiment of the invention.
Figure 5:
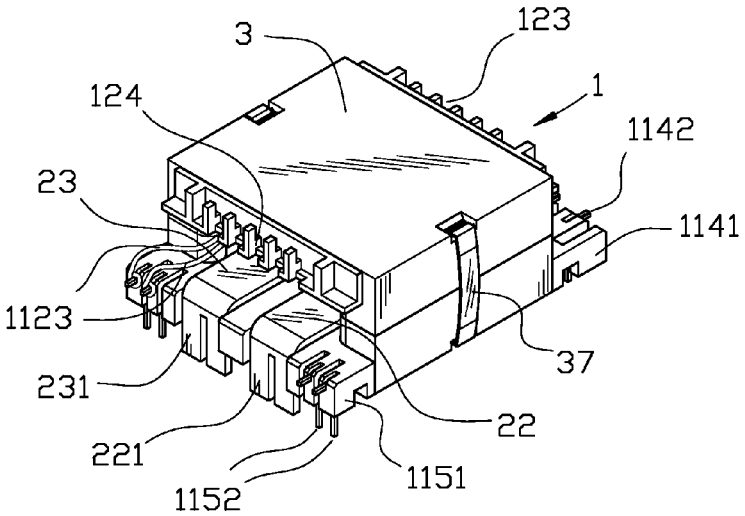
FIG. 5 is an isometric exploded view of the assembled outward appearance of the improved structure of the transformer's lead frame of the first embodiment of the invention.

FIG. 4 is an isometric exploded view and schematic diagram of the partially assembled improved structure of the transformer's lead frame of the first embodiment of the invention while FIG. 5 is an isometric exploded view of the assembled outward appearance of the improved structure of the transformer's lead frame of the first embodiment of the invention. As shown in FIG. 4 and FIG. 5, it is apparent that one can accommodate the two iron cores (3) to implement for the transformer's lead frame structure of the first embodiment of the invention. A salient main core part (31) capable of stretching into the through hole (111) of the lead frame main body (11) is furnished at the center of the each of the iron cores (3). Moreover, two oppositely configured side wing parts (32) are furnished at the outer sides of the main core part (31). What is more, a containing circumferential trench (33) capable of containing the lead frame main body (11) is formed between the main core part (31) and the side wing parts (32). Furthermore, there are two side openings (34), (35) oppositely configured at the containing circumferential trench (33). Finally, a securing indented part (36) is also provided on the bottom side of the iron core (3).

When it comes to assembling, firstly, one has the waist part (21) of the trouser-like flap (2) slip on the periphery of the bobbin (112) of the lead frame main body (11) making the wire-connecting legs (221), (231) pass through the two indented openings (1153), (1154) toward the extended directions of the spare conducting post (1152). Afterward, the lead frame cover (12) is employed to cover on the side away from a side end of the extension parts (114), (115) of the lead frame main body (11). By employing the combination between the combining parts (113) (hook parts) and the to-be-combined parts (122) (reverse hook part), one is capable of making the lead frame cover (12) firmly combine with the lead frame main body (11), and in the mean time, prevent the trouser-like flap (2) from being come off, then, further employing a conducting wire (the enamel covered wire) to wind around the outer circumference of the trouser-like flap (2) so as to obtain the required winding (1121) (as shown in the Figures, the winding 1121 includes a primary winding and a control winding [not shown in the Figures], and the amount of the control winding can be added and subtracted in actual application) to make the winding (1121) have the two wire drawing heads (1122) of the primary winding embedded in the clip indentations (123) of the lead frame cover (12) respectively to form temporary positioning while the two drawing heads (1123) of the control winding can be embedded in the clip indentation (124) of the lead frame cover (12) to form temporary positioning. As the configured and distributed widths of the clip indentations (123), (124) are smaller than the widths of the extension parts (114), (115), the drawing heads (1122), (1123) are apt to be kept within the widths without being come-off from the two outer sides of the extension parts (114), (115) after the drawing heads (1122), (1123) are embedded into the clip indentations (123), (124). In this way, as the two iron cores (3) contact each other with their main core parts (31) stretching through the through hole (111) of the lead frame main body (11) respectively, the side wing parts (32) of the main core parts (31) will also contact each other. Moreover, since the drawing heads (1122), (1123) are not apt to be moved to the outside positions of the extension parts (114), (115), the contact between the two opposite facing side wing parts (32) will not press the drawing heads (1122), (1123), and the wire connecting seats (1141), (1151) of the lead frame main body (11) will stretch outward through the side openings (34), (35). What is more, the clip fasteners (37) are employed to clip into the securing indented parts (36) of the iron cores (3) to maintain the combined status of the two iron cores (3). Lastly, the drawing heads (1122), (1123) are brazed to the primary winding conducting post (1142) and spare conducting post (1152) respectively to accomplish the assembling work of the overall transformer.

Figure 8:
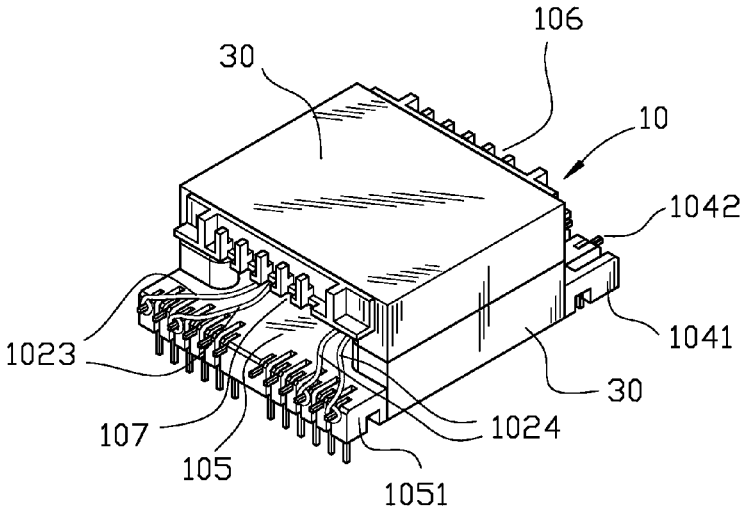
FIG. 8 is an isometric exploded view of the assembled outward appearance of the improved structure of the transformer's lead frame of the second embodiment of the invention.
Figure 6:
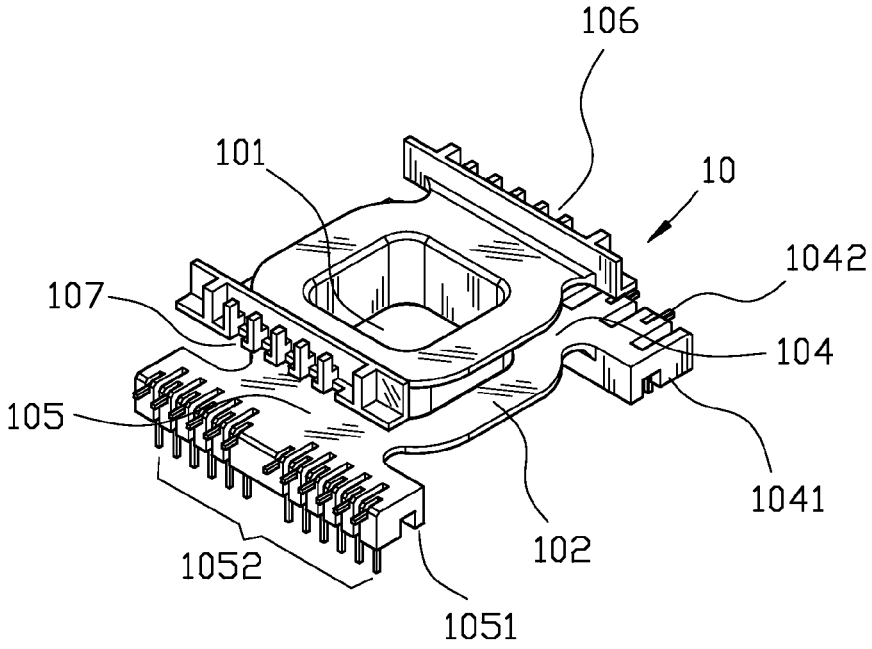
FIG. 6 is an isometric exploded view of the improved structure of transformer's lead frame of the second embodiment of the invention.
Figure 7:
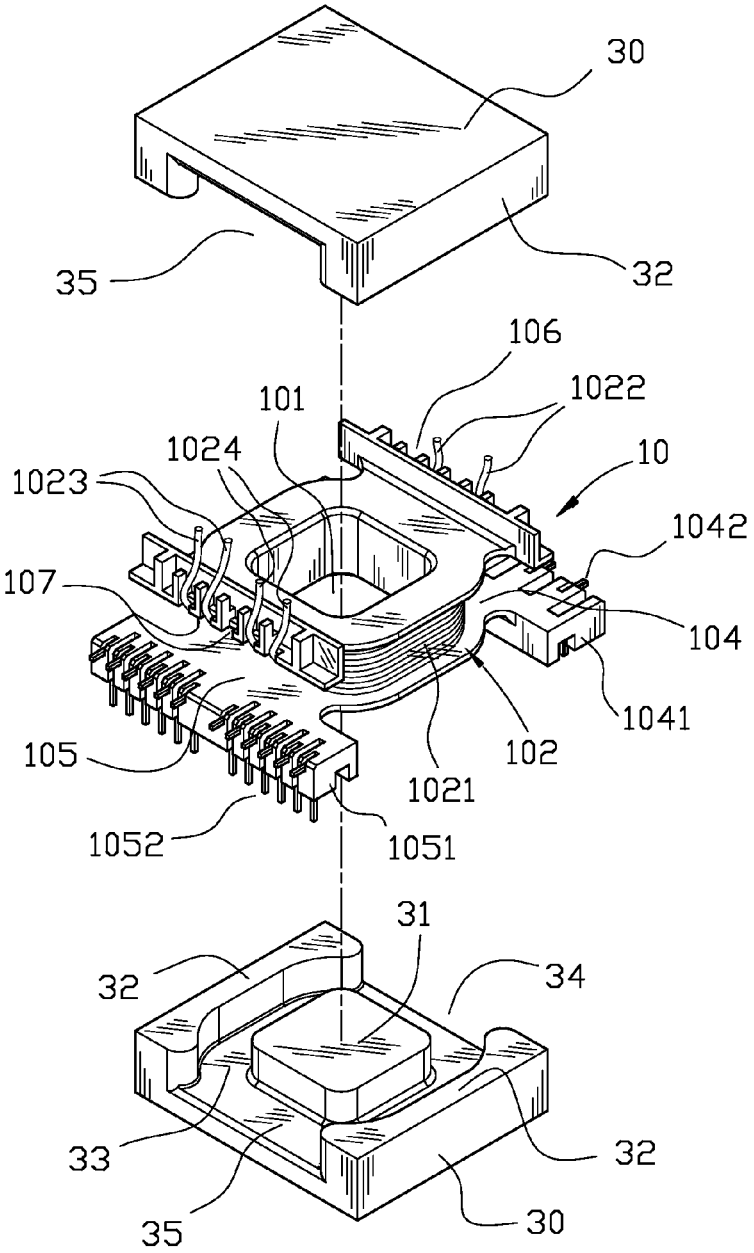
FIG. 7 is an isometric exploded view and schematic diagram of the partially assembled improved structure of the transformer's lead frame of the second embodiment of the invention.

FIG. 6 is an isometric exploded view of the improved structure of transformer's lead frame of the second embodiment of the invention; FIG. 7 is an isometric exploded view and schematic diagram of the partially assembled improved structure of the transformer's lead frame of the second embodiment of the invention; while FIG. 8 is an isometric exploded view of the assembled outward appearance of the improved structure of the transformer's lead frame of the second embodiment of the invention. As shown in FIG. 6, FIG. 7, and FIG. 8, it is apparent that the invention is the structure of transformer or inductor applicable to employ a general conducting wire (enamel covered wire) as a winding. The structure mainly includes an integrally formed lead frame module (10) having a through hole (101) furnished at the center thereof. The through hole (101) has a bobbin (102) formed at the side of the circumference thereof, and two oppositely and reversely extended extension parts (104), (105) are furnished respectively at the periphery of an end thereof. The extension parts (104), (105) are combined at the mid-section of the wire connecting seats (1041), (1042) respectively. A plurality of primary winding conducting post (1042) and a plurality of secondary winding conducting post (1052) are furnished at the wire connecting seats (1041), (1042) respectively. Moreover, a plurality of clip indentations (106), (107) furnished at intervals and at the mid-section of the edge of the two sides of the corresponding extension parts (104), (105) and at the positions covered by the width of the corresponding extension parts (104), (105).

It is apparent that one can accommodate the two iron cores (30) to implement for the transformer's lead frame structure of the second embodiment of the invention. A salient main core part (31) capable of stretching into the through hole (111) of the lead frame main body (11) is furnished at the center of the each of the iron cores (30). Moreover, two oppositely configured side wing parts (32) are furnished at the outer sides of the main core part (31). What is more, a containing circumferential trench (33) capable of containing the lead frame main body (11) is formed between the main core part (31) and the side wing parts (32). Furthermore, there are two side openings (34), (35) oppositely configured at the containing circumferential trench (33).

When it comes to assembling, firstly, employing a conducting wire (the enamel covered wire) to wind in the bobbin (102) to obtain the required winding (1121) (as shown in the Figures, the winding 1021 includes a primary winding, a secondary winding, and a control winding [not shown in the Figures], and the amount of the control winding can be added and subtracted in actual application) to make the winding (1021) have the two wire drawing heads (1022) of the primary winding embedded in the clip indentations (106) respectively to form temporary positioning while the two drawing heads (1023) of the second winding and the two drawing heads (1024) of the control winding can be embedded in the clip indentation (107) to form temporary positioning. As the configured and distributed widths of the clip indentations (106), (107) are smaller than the widths of the extension parts (104), (105), the drawing heads (1022), (1023), and (1024) are apt to be kept within the corresponding widths of the extension parts (104), (105) without being come-off from the two outer sides of the extension parts (104), (105) after the drawing heads (1022), (1023), and (1024) are embedded into the clip indentations (106), (107). In this way, as the two iron cores (30) contact each other with their main core parts (31) stretching through the through hole (101), the side wing parts (32) of the main core parts (31) will also contact each other. Moreover, since the drawing heads (1022), (1023), and (1024) are not apt to be moved to the outside positions of the extension parts (104), (105), the contact between the two opposite facing side of the wing parts (32) will not press the drawing heads (1022), (1023), and (1024), while the wire connecting seats (1041), and (1151) will stretch outward through the side openings (34), (35). Lastly, the drawing heads (1022), (1023), and (1024) are brazed to the primary winding conducting post (1042) and the secondary winding conducting post (1052) respectively to accomplish the assembling work of the overall transformer.

It is understood from the above-mentioned statement, the improved structure of transformer's lead frame has the efficacies of actually simplifying the manufacturing process and preventing the assembling work of the iron core from being interfered by the occupied positions of the drawing heads.

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. An improved structure of transformer's lead frame, comprising at least a lead frame module (1) having a through hole (111) furnished at the center thereof, a bobbin (102) formed at the side of the circumference of the through hole (111), a pair of oppositely configured and reversely salient extension parts (114), (115) furnished at sides of the circumference of the through hole (101), each of the extension parts (114), (115) is combined to the mid-section of the connecting seats (1141), (1151) that have a plurality of wire connecting posts (85), (851), a plurality of clip indentations (123), (124) are furnished at intervals and at the mid-section of the edge of the two sides of the corresponding extension parts (114), (115) and at the positions covered by the width of the corresponding extension parts (114), (115); wherein the lead frame module (1) is consisted of a lead frame main body (11) and a lead frame cover (12), the lead frame main body (11) having a bobbin (112) and the through hole (111) furnished at the center thereof has the pair of oppositely configured and reversely salient extension parts (114), (115) that are connected to the mid-section of a wire connecting seats (1141), (1151) respectively; the lead frame main body (11) also has at least a pair of oppositely configured combining parts (113) furnished at the edge of the other end of the through hole (111); the lead frame cover (12) being a sheet body and having a through hole (121) furnished at the center thereof and corresponded to the through hole (121) of the through hole (111) has at least two to-be-combined parts (122) furnished at the inner edge of the circumference of the through hole (121) and corresponded to each of the combining parts (113), the lead frame cover (12) also has a plurality of clip indentations (123), (124) furnished at intervals and at the mid-section of the edge of the two sides of the corresponding extension parts (114), (115); wherein the combining parts (113) is a hook part and the to-be-combined parts (122) is a reverse hook part; wherein the bobbin (112) of the lead frame main body (11) provides the trouser-like flap (2) that has its hollow part (21) capable of slipping on the bobbin (112), and a pair of wire connecting legs (321), (331) are provided at an end of the trouser-like flap (2), and one of the wire connecting seats (1041), (1042) of the lead frame main body (11) has a plurality of indented openings (1153), (1154) furnished at one of the wire connecting seats (1041), (1042) of the lead frame main body (11) for containing the wire connecting legs (321), (331); wherein two parallel stretching thigh parts (22), (23) of the trouser-like flap (2) are provided between the hollow part (21) and the wire connecting legs (321), (331) and the two parallel wire connecting legs (221), (231).

* * * * *